US005707136A

United States Patent [19]

Byers

[11] Patent Number: 5,707,136

[45] **Date of Patent: *Jan. 13, 1998**

[54] MULTIPLE LIGHT SYSTEMS

[76] Inventor: Thomas L. Byers, 5480 Stewart Dr., Mustang, Okla. 73064

[ * ] Notice: The term of this patent shall not extend beyond the expiration date of Pat. No. 5,513,081.

[21] Appl. No.: 607,225

[22] Filed: Feb. 26, 1996

[51] Int. Cl.[6] ..... F21V 21/08

[52] U.S. Cl. ..... 362/145; 362/249; 362/806; 362/396; 362/147

[58] Field of Search ..... 362/249, 252, 362/387, 396, 391, 806, 145, 389, 234, 226, 431, 151, 152, 147; 248/314, 223.4; 439/419, 533, 573, 532, 540, 569, 570, 571; 206/419, 420, 421

[56] References Cited

U.S. PATENT DOCUMENTS 3,189,310 6/1965 Trueson .
3,204,090 8/1965 Kvarda, Jr. .
3,384,227 5/1968 Spatz .
3,404,268 10/1968 Fowler .
3,540,687 11/1970 Cuva .
4,128,863 12/1978 Premetz ..... 362/249
5,024,406 6/1991 Ketcham ..... 248/149
5,033,619 7/1991 Garis ..... 206/419
5,036,447 7/1991 Taylor ..... 362/431
5,064,067 11/1991 McAllister et al. ..... 206/420
5,067,061 11/1991 Prickett ..... 362/145

*Primary Examiner*—Thomas M. Sember
*Attorney, Agent, or Firm*—Dougherty & Hessin, P. C.

[57] ABSTRACT

Improvements in components for decorative light strings that include a plurality of track channels for holding successive segments of a light string, such track channel sections being supportable by snap attachment to pre-positioned snap-fasteners or the like.

13 Claims, 9 Drawing Sheets

MULTIPLE LIGHT SYSTEMS

CROSS-REFERENCE TO RELATED APPLICATION

The present application is related to application Ser. No. 08/429,895 as filed on Apr. 27, 1995, now U.S. Pat. No. 5,513,081 and entitled "MULTIPLE LIGHT INSTALLATION AND STORAGE SYSTEMS".

1. Field of the Invention

The invention relates generally to multiple light strings and, more particularly, but not by way of limitation, it relates to further improved apparatus for installation and handling of decorative light arrays.

2. Description of the Prior Art

There is prior art extending back over a long period of time that relates to light strings and apparatus for mounting various types of indoor and outdoor decorative displays. An early U.S. Pat. No. 3,189,310 discloses an outside light holder for Christmas lights that consists of a cylindrical holder that may be fastened to a building roof or facia location to hold an individual Christmas light socket. U.S. Pat. No. 3,204,090 shows another early form of light string support wherein a channel member is adapted for mounting of a string of spaced Christmas lights, and the channel member is fitted with a hook edge for the purpose of suspending the channel from the front of residential guttering thereby to display light pattern along the roof eave line. U.S. Pat. No. 3,540,687 teaches an individual light socket retaining means that consists of a base element for mounting to a house or similar structure and includes a clip-type light socket holder that is attachable to the base element. A plurality of such base element/clip holders may be attached to the residential structure in order to mount a string of decorative lights.

SUMMARY OF THE INVENTION

The present invention relates to improvement components for a decorative light installation. Multiple electric light strings are designed for insertion and seizure along a light track channel of designated length. The track channel includes a snap channel disposed centrally along the bottom of the track channel for pressure fixture to a molded snap button that may be permanently secured to a mounting site such as a residential roof or facia. A multiple of such track channels, clips and slideways are included herein, and such fixtures extend the design choices of individual components making up a light string array.

Therefore, it is an object of the present invention to provide an alternative form of mounting track channels and accessories carrying a string of multiple light bulbs releasibly positioned thereon.

It is also an object of the present invention to provide a storage rack that is interactively compatible for carrying a multiple of individual track channels with light strings for subsequent storage.

Finally, it is an object of the present invention to provide multiple light track channels and storage racks that are sturdy yet light in weight.

Other objects and advantages of the invention will be evident from the following detailed description when read in conjunction with the accompanying drawings that illustrate the invention.

DETAILED DESCRIPTION OF THE INVENTION

Figure 1:
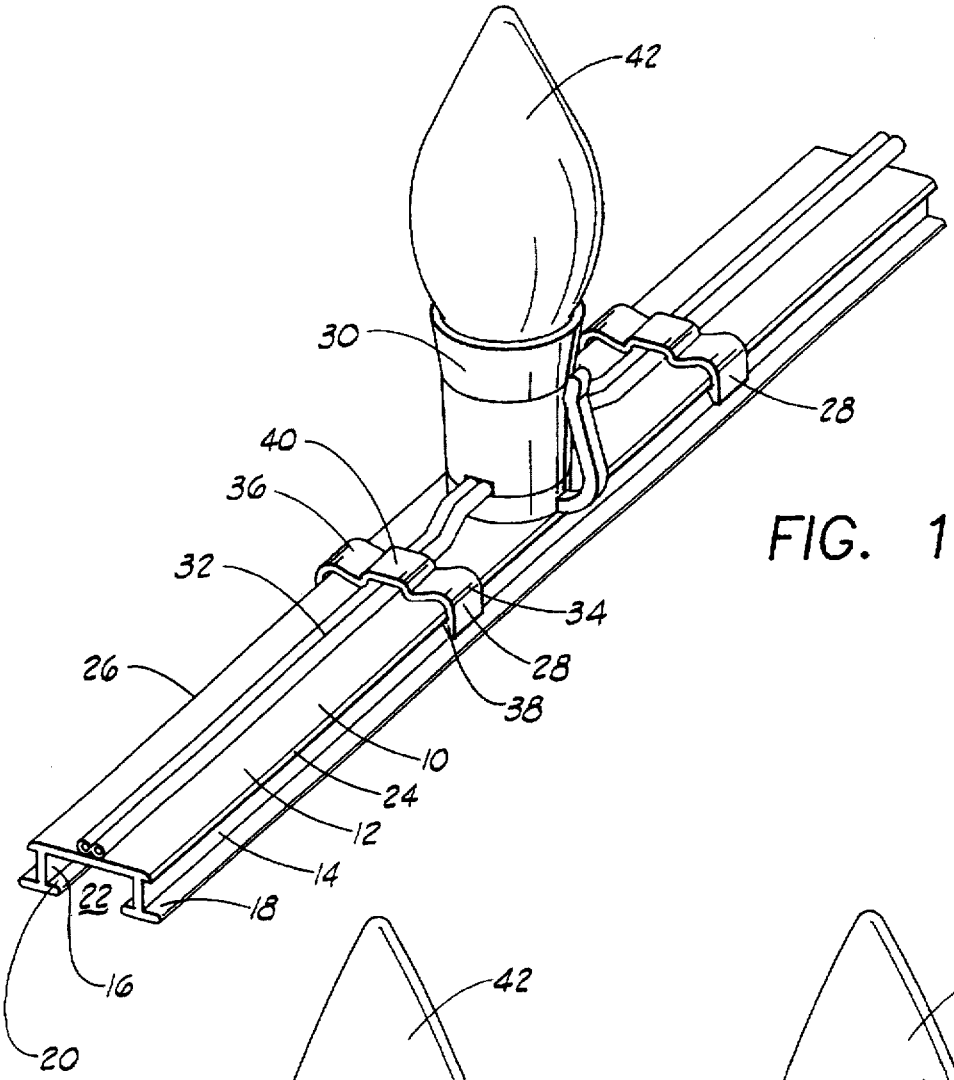
FIG. 1 is a perspective view of a section of track channel with light string attached.

FIG. 1 illustrates a modified form of track channel 10 that is formed as a flat upper panel 12 having opposite underside panels 14 and 16 with parallel, opposite side base panels 18 and 20 defining the slideway 22 therebetween. Opposite side flanges 24 and 26 of the upper panel 12 provide a gripping surface for each of clips 28 which hold the light sockets 30 and wire bundle 32 in central alignment upon the track channel 10.

The clips 28 are formed with opposite side shoulders 34 and 36 which terminate with a respective tooth flange 38 for gripping beneath the side flanges 24 and 26. A raised formation 40 at the center of clip 28 provides keeper space for the wire bundle 32, in this case a two-wire pair. Thus, an elongate section of track channel 10 may have secured thereon, by means of a plurality of clips 28, a section of light string carrying a plurality of light sockets 30 and bulbs 42. Typically, a six-foot section of track channel 10 may be adapted to carry on the order of eight sockets 30 arrayed on a wire bundle 32 by placing two clips 28 on opposite sides of each light socket 30 along the length of track channel 10. If additional lights exist in the string, then one or more additional track channels 10 may be secured to support the additional light socket length. While a two-wire pair is shown in support of the light array, it should be understood that the multiple wire arrays, such as the Oriental multi-wire light riggings, may also be operatively retained along a light channel 10 by means of the clips 28.

Figure 2:
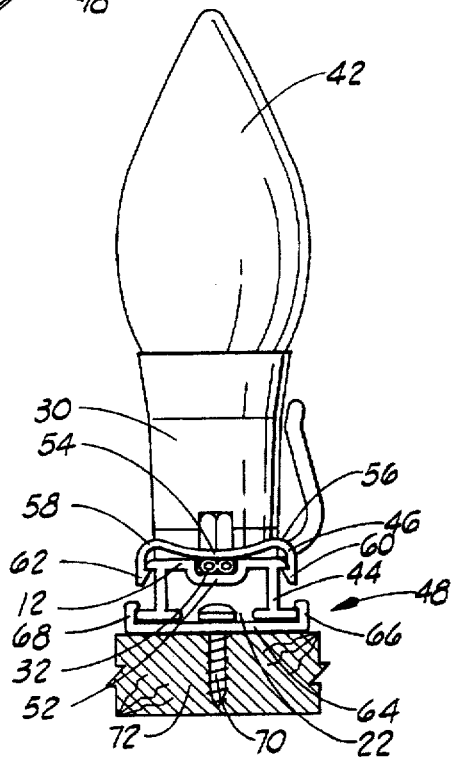
FIG. 2 is a view in vertical section of a track channel and light element affixed to a slide channel support structure.
Figure 3:
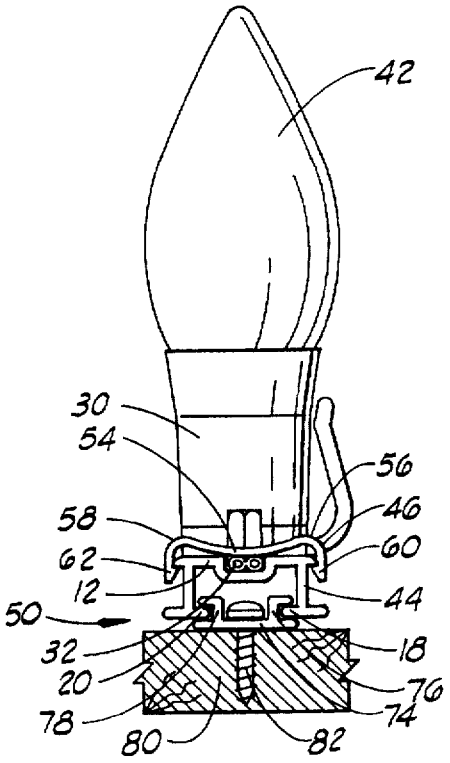
FIG. 3 is a view in vertical section of an alternative form of track section as affixed to an alternative form of slide channel.

FIGS. 2 and 3 illustrate an alternative form of track channel 44 and clip 46 as they may be retained by either a slide channel 48 or, alternatively, a slide channel 50. FIGS. 2 and 3 both illustrate a track channel 44 which is slightly different in that upper panel 12 is formed with a central groove 52 which carries the wire bundle 32 in recess. The clips 46 are then formed with a bowed center section 54, opposite side shoulders 56 and 58 which terminate in respective tooth flanges 60 and 62 to seize around the upper panel of track channel 44. In FIG. 2, a slide channel 64 having opposite side guide channels 66 and 68 is mounted by means of plural, spaced screw fasteners 70 to a mounting member 72. In FIG. 3, a slide guide 74 is formed with opposite side guide channels 76 and 78 which slidably receive the inner flange edges 20 and 18 of the track channel. The slide guide 74 is also secured to a mounting member 80 by means of a plurality of fasteners 82.

Figure 4:
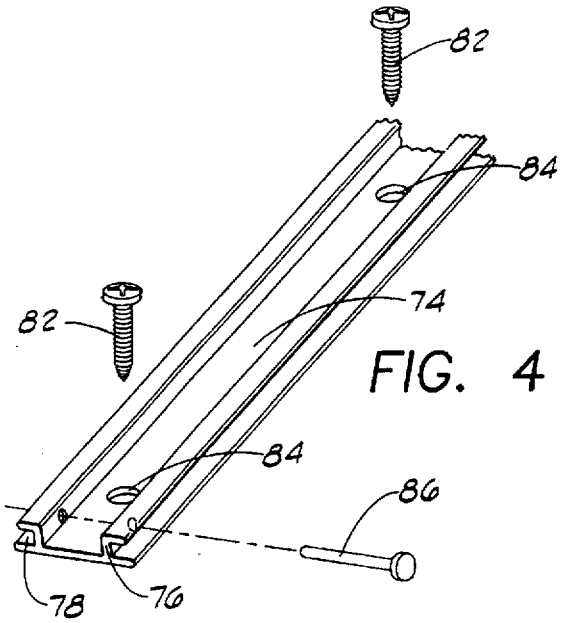
FIG. 4 is a perspective view of a section of slide channel with fasteners.
Figure 5:
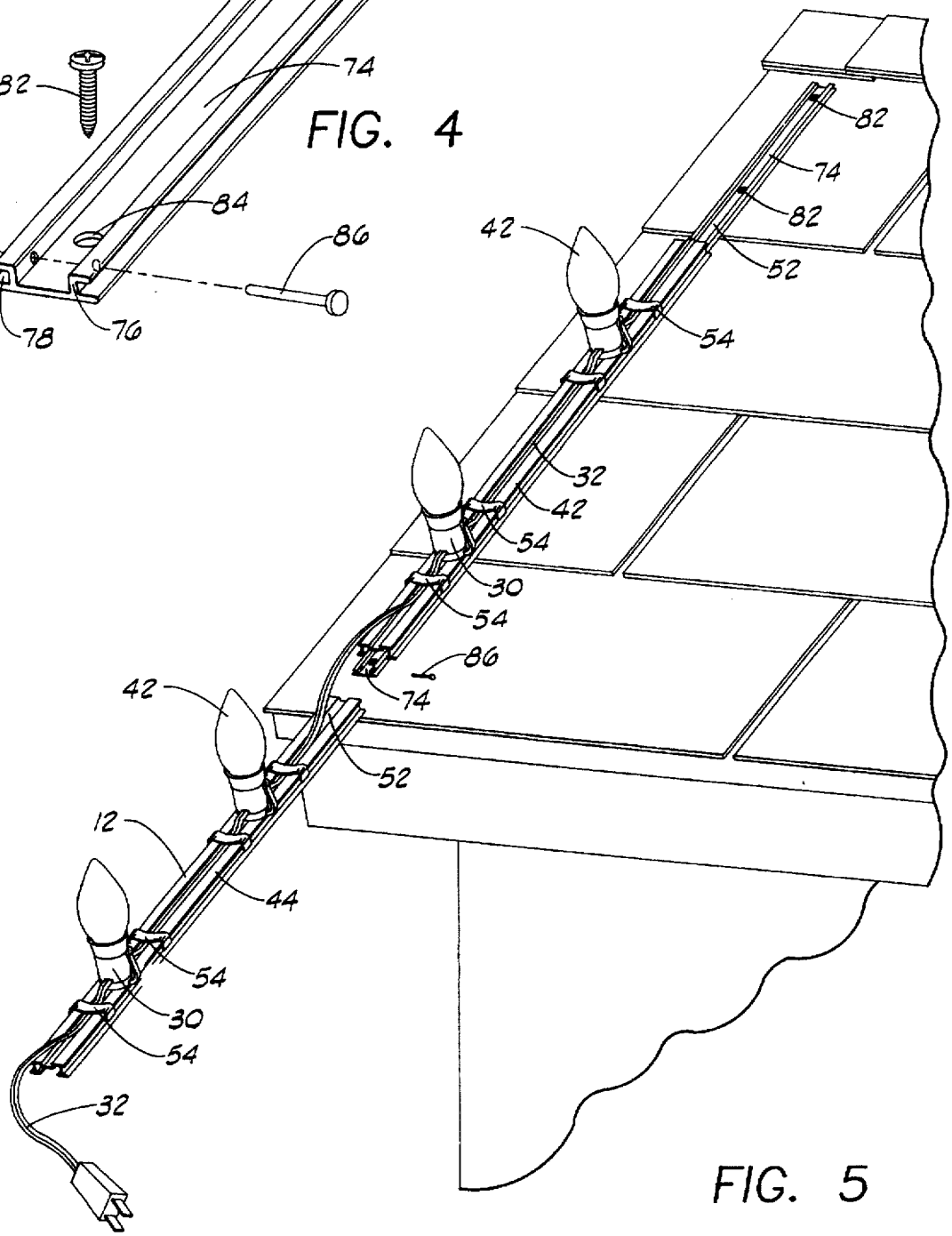
FIG. 5 illustrates the sliding placement of track channels with light string slidably disposed in a slide channel as affixed to roof structure.

FIGS. 4 and 5 illustrate the slide guide 74 in greater detail wherein it is utilized for roof installation. The slide guide 74 is secured to a rooftop in selected positioning by means of a plurality of screw fasteners 82 in holes 84 in a predesigned pattern. Then the assembled track light structure with sockets 30 and wire bundle 32 installed along the track channel 44 and secured with a plurality of clips 54 may be easily slid onto the slide guide 74 and into proper position along the roof structure. Once the track channel 44 has been positioned up along slide guide 74, a keeper pin 86 may be inserted horizontally through track channel 74 thereby to maintain the track channel in operative position. A plurality of such track assemblies may be pushed up the slide guide 74 as each track channel 44 serves to push the next track channel 44 section until the full complement of track channels 44 has been placed. Thus, such slide guide installed light tracks can be installed and removed without climbing on the roof.

Figure 6:
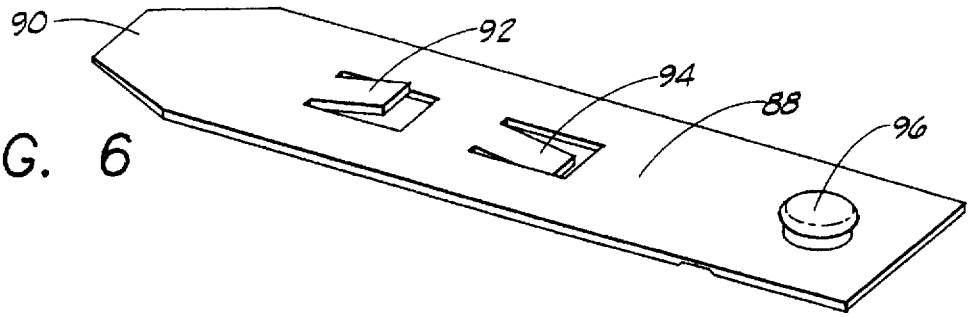
FIG. 6 is a perspective view of a friction tab for roof edge installation.
Figure 7:
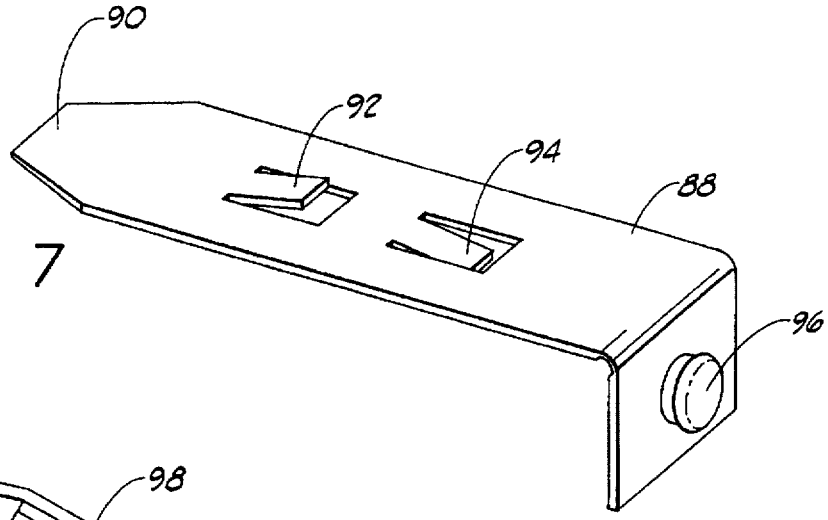
FIG. 7 is a perspective view of a right angle form of friction tab for roof edge installation.
Figure 8:
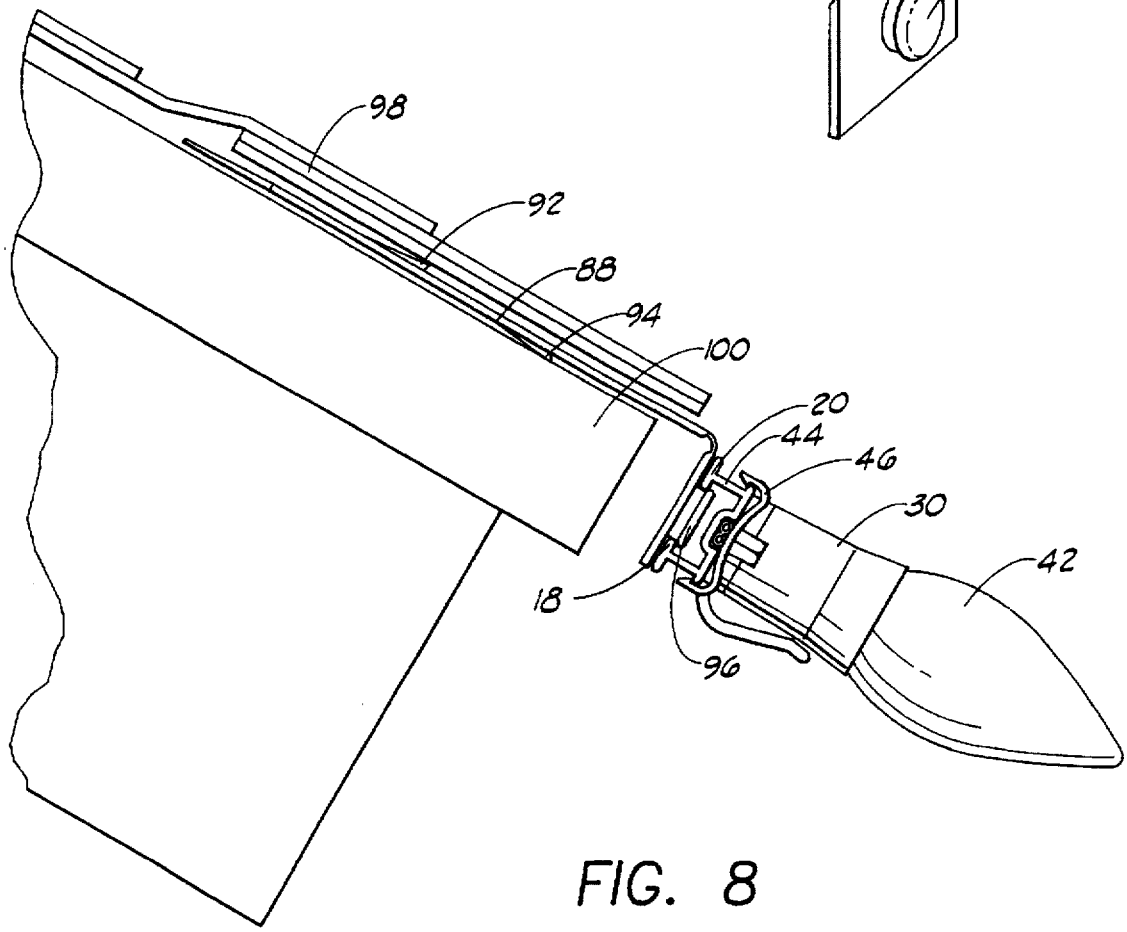
FIG. 8 illustrates in elevation a roof with right angle friction tab carrying track channel and light string.

FIGS. 6, 7 and 8 illustrate the manner whereby friction or shingle tabs may be utilized for the light track assembly. Thus, referring to FIG. 6, a flat shingle tab 88 may be formed of plastic or metal with a relatively sharpened upper edge 90 for insertion beneath the shingle structure and a pair of oppositely formed punch wedges 92 and 94 grip to secure the shingle tab 88 in position at roof edge. The shingle tab 88 includes a flange button 96 which is of a size to be secured to the underside of a track channel 44 (see FIG. 8). FIG. 7 illustrates the same shingle tab 88 as it is formed with a 90° bend at the lower end so that the securing button 96 supports the light string in a generally horizontal attitude. As shown in FIG. 8, the shingle tab 88 may be secured between the shingles 98 and roof panel 100 to extend the securing button 96 outward from the roof. A track channel 44 may then be arrayed along a plurality of such shingle tabs 88 as the track channel 44 flanges 20 and 18 (slideway 22) are snap-fit over the securing buttons 96 along the length of the predesignated pattern.

Figure 9:
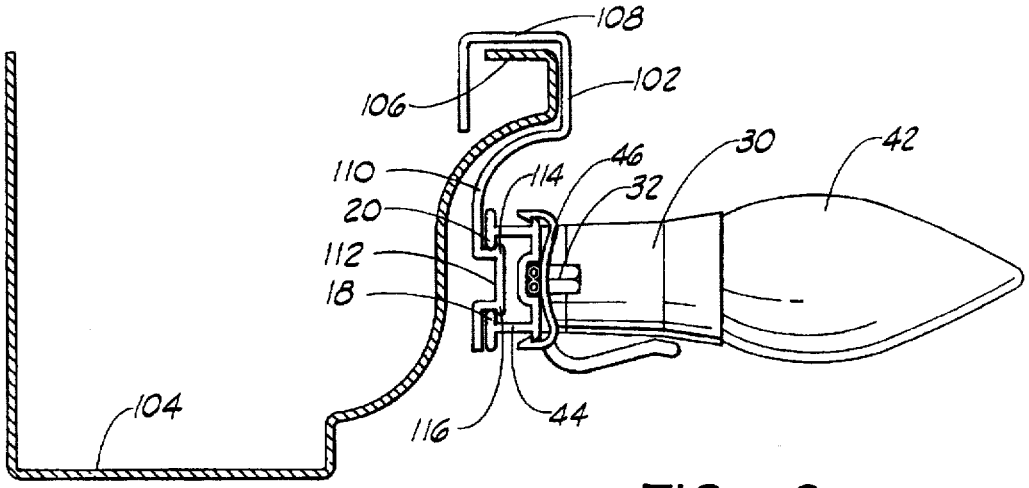
FIG. 9 is a view in section showing a gutter clip carrying channel and light string.
Figure 10:
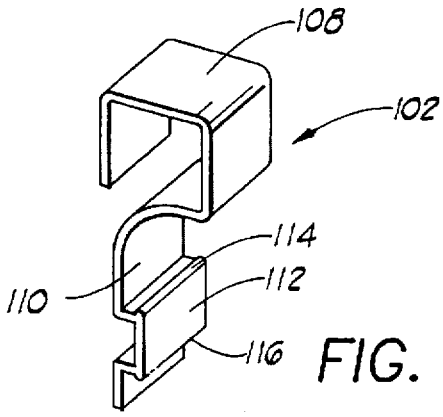
FIG. 10 is a perspective view of the gutter clip element of FIG. 9.
Figure 11:
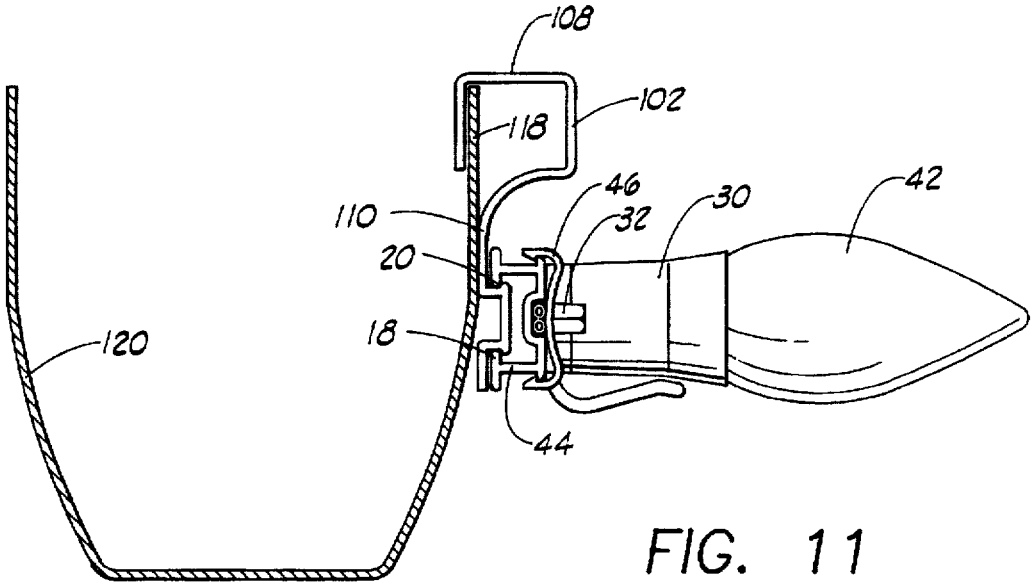
FIG. 11 is a view in vertical section of the gutter clip of FIG. 9 with light string secured on a plastic roof gutter.

FIG. 9 illustrates a gutter clip 102 that may be connected to the front edge of a typical metal-type gutter 104 by affixture over the square, front edge 106. A plurality of gutter clips 102 may be arrayed along the gutter 104 to support a track channel 44 carrying a light string consisting of wire bundle 32, sockets 30 and bulbs 42. As shown in FIG. 10, the gutter clip 102 is formed to include a square upper hook structure 108 that is hooked over square structure 106 of gutter 104, and the lower part of gutter clip 102 curves down to a vertical panel 110 to form a button-like rail 112 having upper and lower flanges 114 and 116. The track channel flanges 20 and 18 (slideway 22; FIG. 1) may then be tightly received over the flanges 114 and 116 of rail 112. FIG. 11 illustrates the manner in which the gutter clip 102 may also connect over the front edge 118 of a typical plastic-type gutter 120. In this case, the top hook structure 108 of gutter clip 102 hangs over the front edge 118 of gutter 120 while the central portion of panel 110 is allowed to rest against the front of gutter 120.

Figure 12:
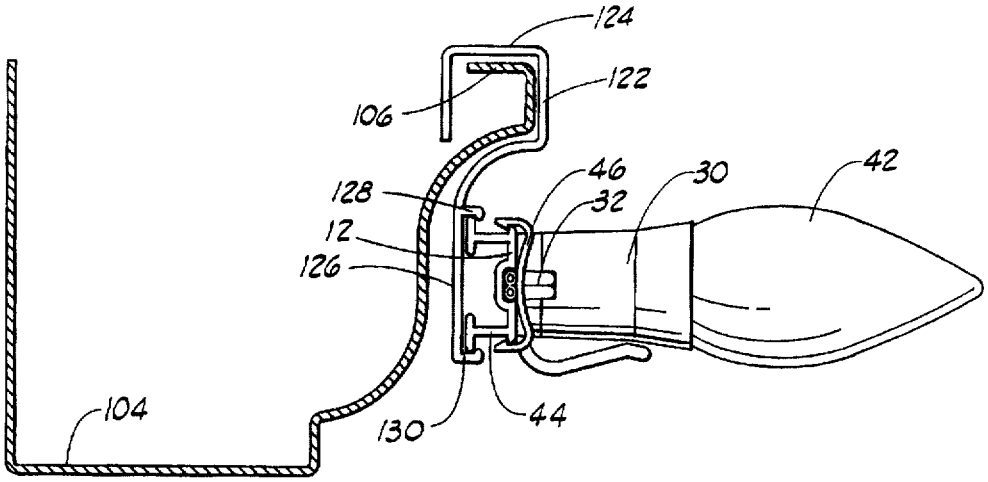
FIG. 12 is a view in section of yet another form of gutter clip as secured on metal-type roof gutter.
Figure 13:
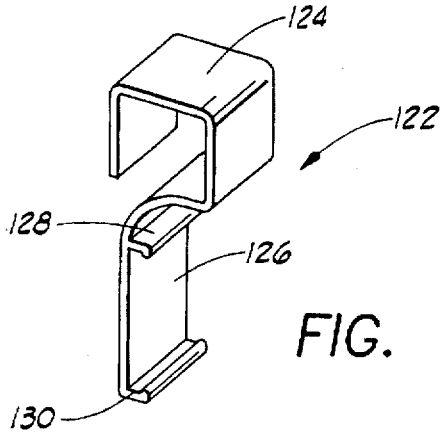
FIG. 13 is a perspective view of the gutter clip shown in FIG. 12.

FIG. 12 illustrates the manner in which a gutter clip 122 (FIG. 13) is adapted to hang over the front edge 106 of a metal-type gutter 104. Referring to FIG. 13, the alternative gutter clip 122 is also formed into a relatively square hook structure 124 which then extends into a vertical panel 126 having parallel upper and lower flanges 128 and 130 formed thereon. The flanges 128 and 130 form a slideway for receiving a track channel 44 (FIG. 12) therein as track channel 44 supports a light string array. A plurality of sockets 30 with bulbs 42 are retained along track channel 44 as a plurality of clips 46 are positioned across wire bundle 32 on each side of each socket 30.

Figure 14:
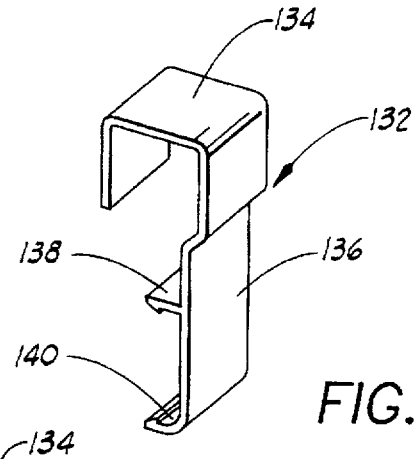
FIG. 14 is a perspective view of yet another type of gutter clip that is suitable for installation on metal-type or plastic type roof gutter.
Figure 15:
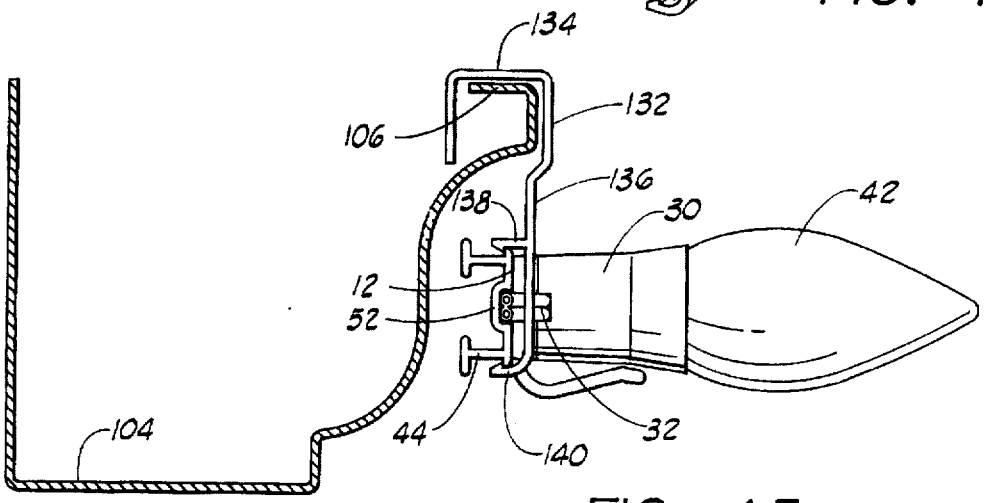
FIG. 15 is a view in vertical section of the gutter clip of FIG. 14 installed and carrying a light string.

FIG. 14 shows yet another alternative form of gutter clip 132 which is formed to have a square hook structure 134 at the upper end and is formed with a vertical panel 136 which carries opposed, parallel slide flanges 138 and 140 on the inner side, i.e., the side of vertical panel 136 toward the hook structure 134. As shown in FIG. 15, a track channel 44 carrying a light string can be supported on the rearward side of vertical panel 136 by means of the parallel flanged channels 138 and 140. In this case, the gutter clips 132 each extend over the top panel 12 of the track channel 44 and serve to retain the wire bundle 32 within the channel 52. A plurality of such gutter clips 132 may be employed in sufficient number to provide support in retaining wire bundle 32 along the total length of light string.

Figure 16:
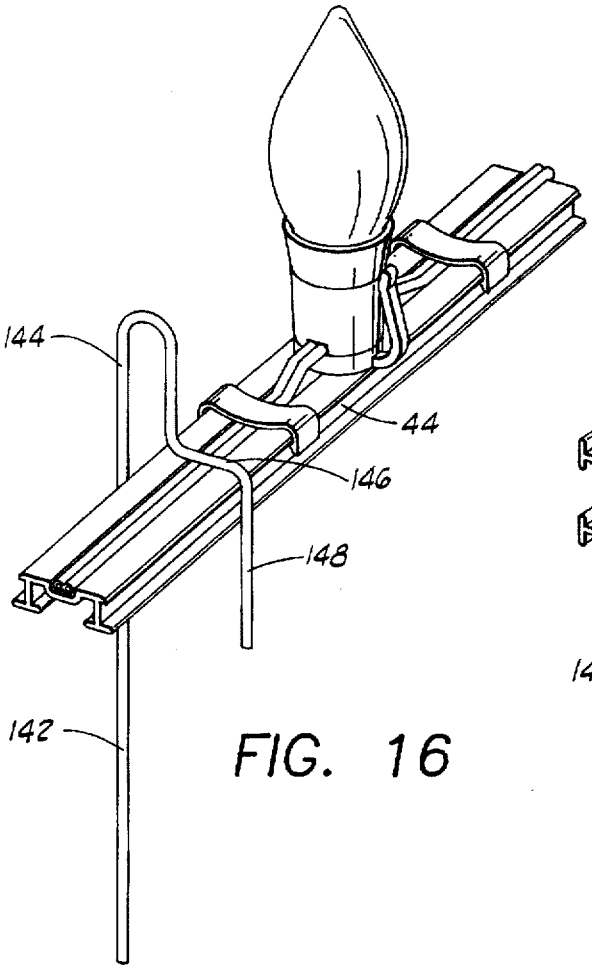
FIG.16 is a wireform yard stake for retaining a light string and track channel in horizontal attitude.
Figure 17:
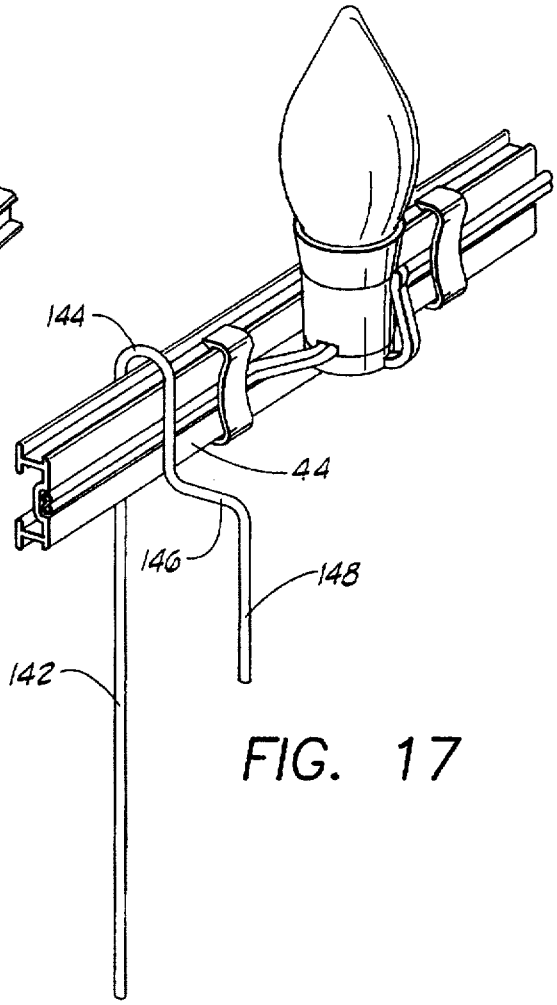
FIG. 17 is a perspective view of the wireform yard stake securing the light track channel in a side vertical attitude.
Figure 18:
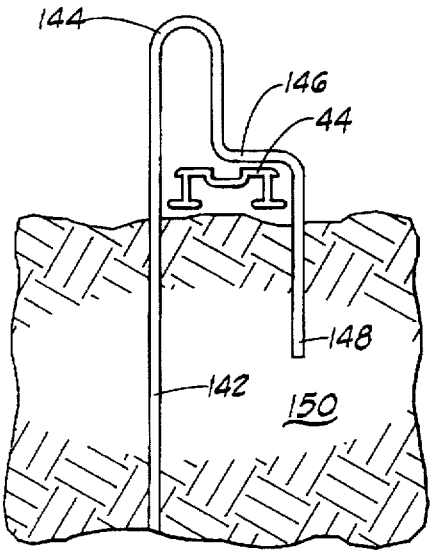
FIG. 18 is an idealized view in vertical section of the yard stake of FIG. 16.
Figure 19:
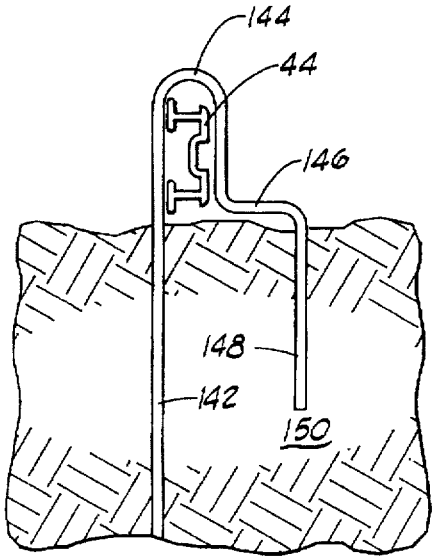
FIG. 19 is an idealized view in vertical section of the yard stake as deployed in FIG. 17.

FIGS. 16, 17, 18 and 19 illustrate the manner in which a wireform yard stake 142 may be utilized in forming certain decorative yard patterns. The yard stake 142 is formed with an upper loop 144 for staking a track channel 44 with light string in a sidewise or vertical attitude as shown in FIGS. 17 and 19. And, yard stake 142 is further bent at right angles to form a sector 146 prior to return to parallel sector 148 which is stabilized in the earth 150. The horizontal sector 146 functions to pin the track channel 44 down flatwise as shown in FIGS. 16 and 18.

Figure 20:
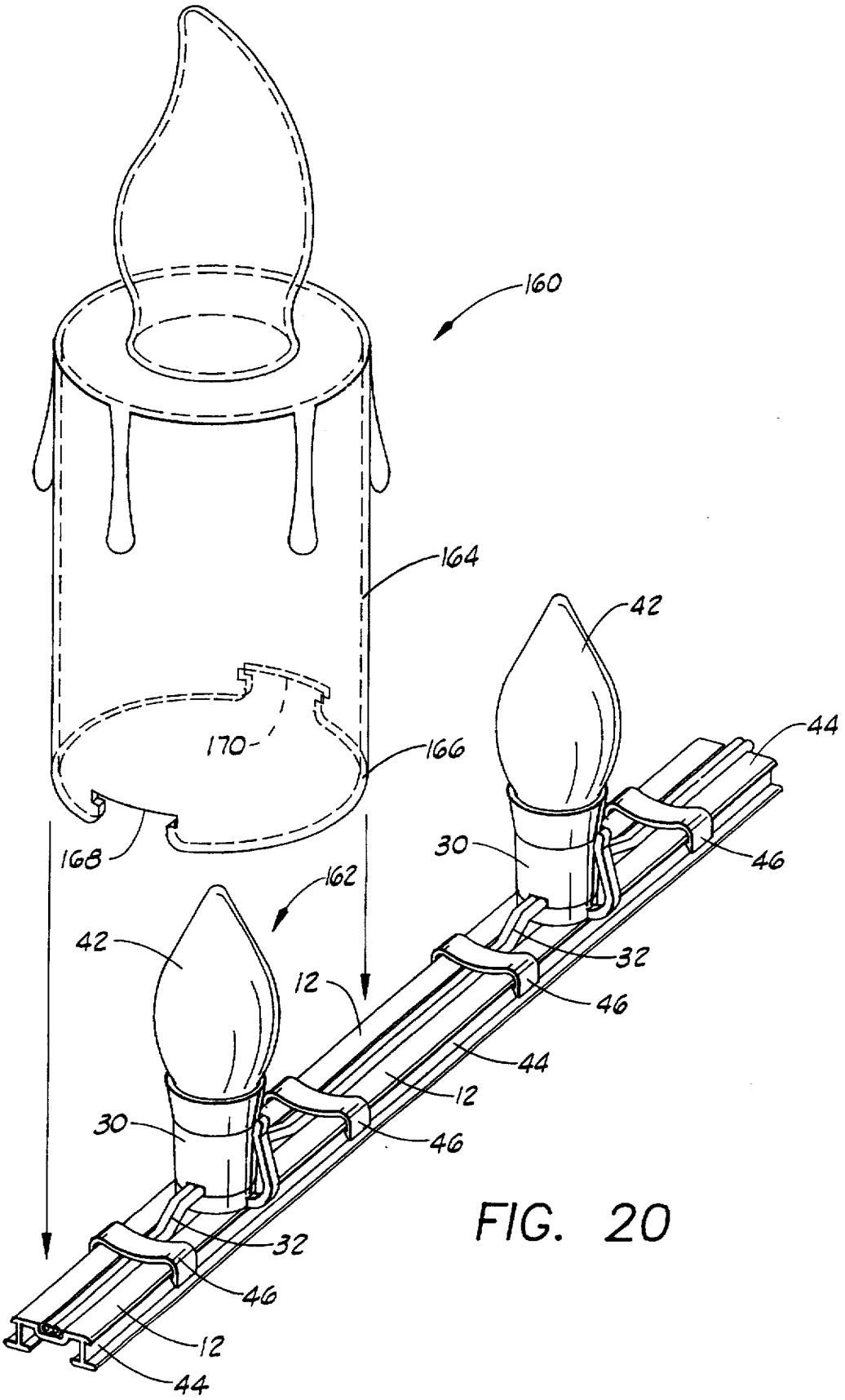
FIG. 20 is a perspective view in exploded form of an illuminated ornament that may be retained on the light track channel.
Figure 21:
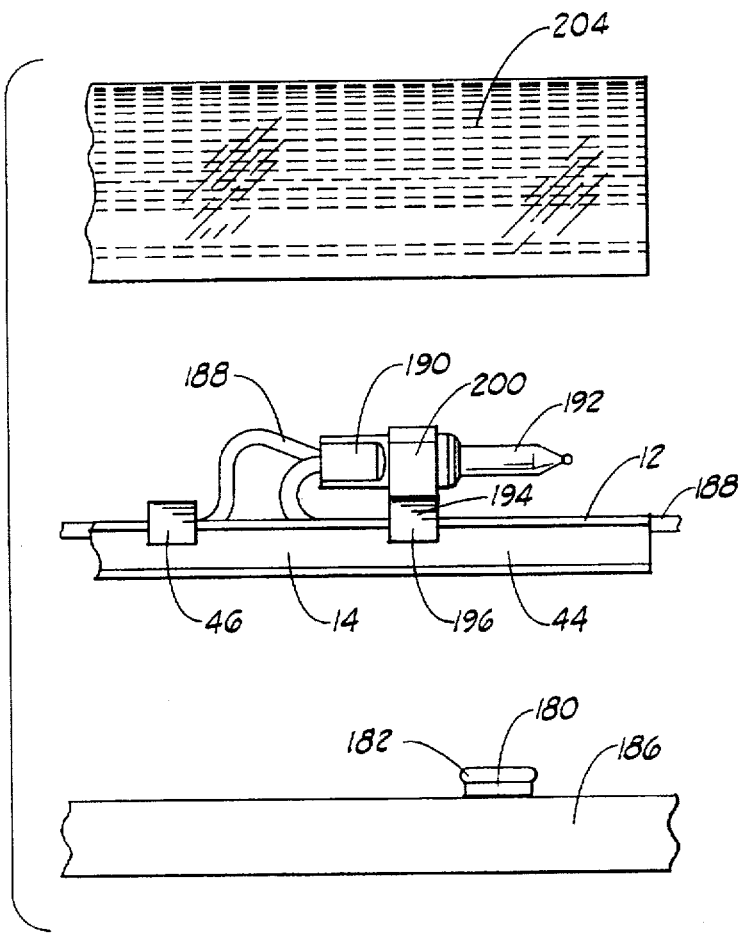
FIG. 21 is an exploded view in side elevation of a base member, track channel with light string and illumination cover of an architectural light display.
Figure 22:
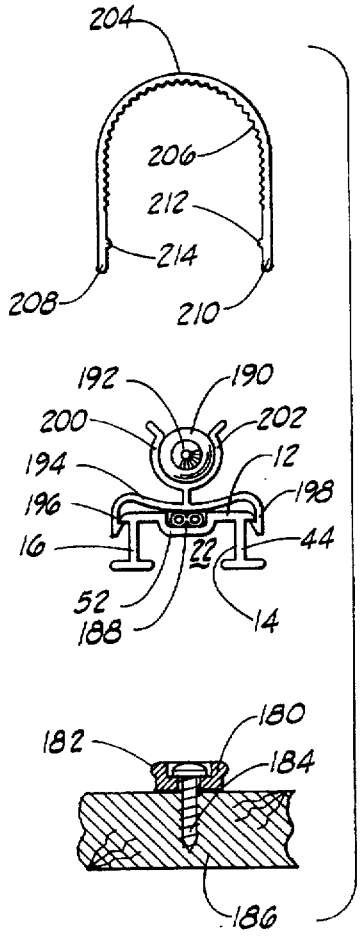
FIG. 22 is an exploded end view of the components of FIG. 21.

FIG. 20 illustrates a decorative accoutrement that may be utilized in combination with track channel light assemblies of the present type. An ornament 160 may be formed from suitable plastic in clear or translucent configuration that is large enough to envelop a single socket and lamp assembly 162. The ornament 160 is formed with the generally rounded lower portion 164 having a bottom rim 166 with opposed cut out portions 168 and 170 which are formed for locking engagement over the top panel 12 of track channel 44. The illuminated ornaments simply snap onto the light tracks while enveloping the lamps 42 to provide a glowing ornamental object. Many different holiday designs are possible such as Santa configurations, snowmen, candles, pumpkins, etc. It is contemplated that many unique designs and combinations will be developed.

FIGS. 21, 22, 23 and 24 relate to an alternative track lighting system including a translucent cover for permanent architectural installation either indoors or outdoors such as around patios or cabanas. Referring to the exploded views of FIGS. 21 and 22, the system utilizes snap buttons 180 having an upper interfering bead 182 and being secured by screw fastener 184 to a mounting base 186. The system utilizes the same type of track channel 44 having upper panel 12 with opposite side flanges 14 and 16 and central channel 52, while the opposite side panels 14 and 16 define a snap channel 22 therebetween.

The Oriental type decorative lights having interconnecting wires 188, sockets 190 and lamp bulbs 192 are supported by means of bulb clamps 194 having opposite side vertical tangs 196 and 198 for gripping the opposite side flanges of top panel 12 of track channel 44. The track clip 194 includes a central formation extending upward therefrom and defining opposed clamp flanges 200 and 202 which seize and hold the socket 190 in a horizontal position relative to the track channel 44. The channel clamp 194 functions to retain the wire bundle 188 down within the channel 52 of track channel 44 as well as to support the socket 190. The wire bundle 188 is also suppressed into channel 52 by means of additional clips 46 disposed as needed along the track channel 44.

Figure 23:
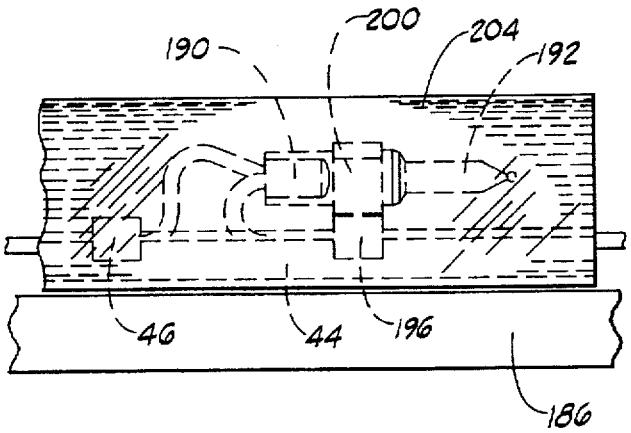
FIG. 23 is a partial side view in elevation showing the elements of FIG. 21 in assembled form.
Figure 24:
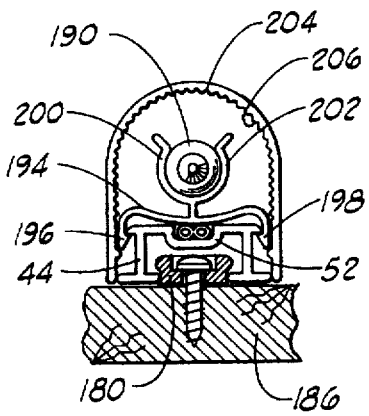
FIG. 24 is an end view in elevation of the components of FIG. 23.

The entire track channel 44 and light string can be covered by an extruded translucent track cover 204. Track cover 204 may be molded or extruded as a U-shaped formation being grooved for faceted lens effect on the inner side 206 while terminating at parallel side ends 208 and 210. A pair of opposed interfering beads 212 and 214 are formed along the inner edge of translucent cover 204 for the purpose of providing interfering or gripping affixture when assembled. FIGS. 23 and 24 illustrate the track lighting system when fully assembled. It should be understood that the light mounting clip 194 may be connected to a track channel 44 which, in turn, is connected to a mounting button or other slide channel; or, the lamp mounting clip 194 may be connected directly to a section of slide guide 74 which is mounted by screw fasteners.

Figure 25:
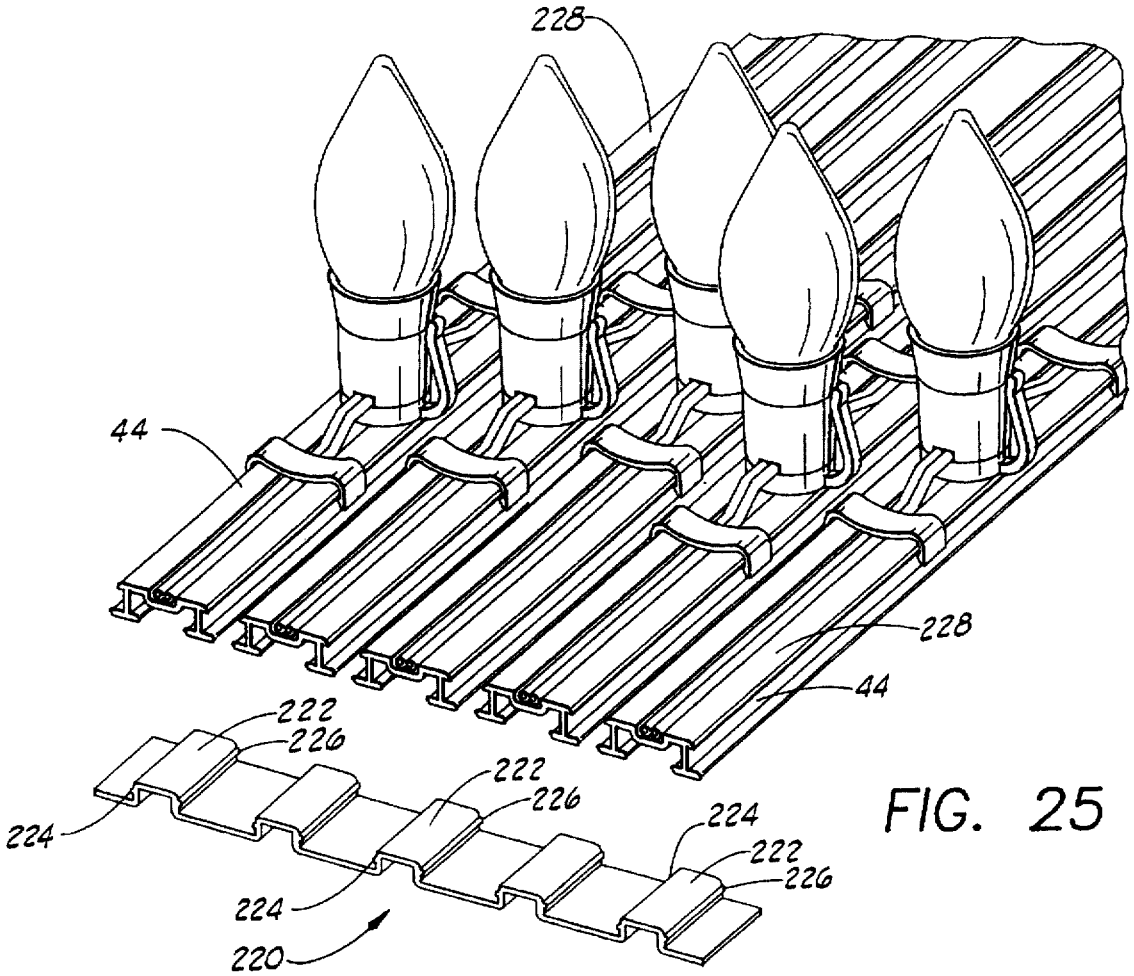
FIG. 25 is a perspective view of a plurality of light track assemblies arrayed in storage mode as coupled by a plurality of storage clips.
Figure 26:
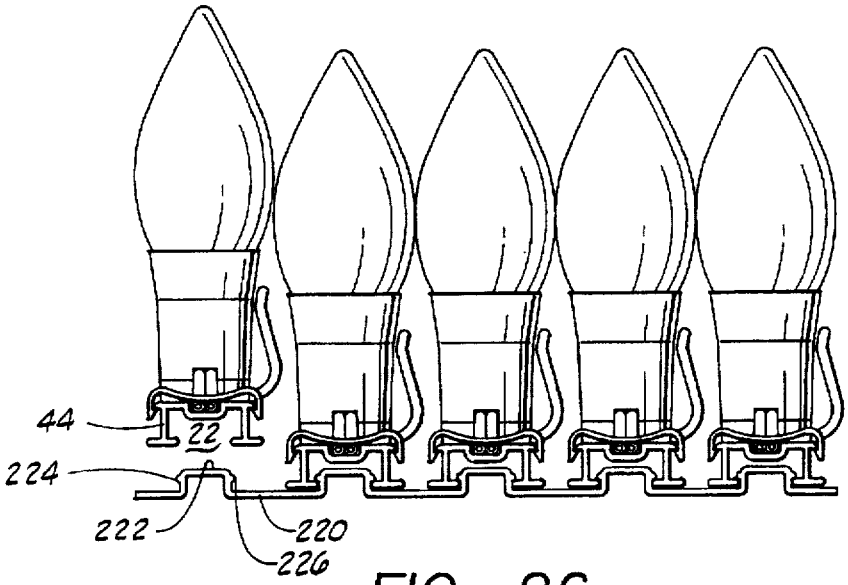
FIG. 26 is an end view in vertical elevation illustrating the manner of securing the light track assemblies and track channels onto the storage clip.

FIGS. 25 and 26 illustrate the use of a multiple track clip 220 as used for retaining a plurality of assembled track sections for storage and transportation. The storage clips 220 may also be cut from extruded stock to provide a plurality of clips 220 having equi-spaced lugs 222, each having opposite side interference beads 224 and 226. The lighting system can then be broken down into the elemental lighting tracks 228, i.e., individual track channels 44 with light strings attached, and the individual channels 22 (FIG. 1) of track channels 44 are snapped onto respective lugs 222 to assemble a multiple of track channels 44 together for transportation or storage. Suitable storage schemes and carriers are shown and described in the aforementioned related patent application, Ser. No. 08/429,895, now U.S. Pat. No. 5,513,081.

The foregoing discloses a number of alternative structures that may be utilized in formation of a track lighting system of a type that is readily deployed, transported and stored. Such lighting systems may be readily deployed for rapid put-up and take-down for holiday seasons or other occasions, and the systems are more easily stored in their assembled condition. Lighting systems constructed in accordance with the present invention provide great time savings in installation and a considerable reduction in loss from breakage. Thus, the present invention enables transport and storage of a relatively large number of lights on one or more light strings, with the entire storage rack and light string assembly being light in weight and of a size that is not unwieldy.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. Mounting apparatus for securing an electrical wire bundle with spaced lamp sockets in operative disposition on a building structure, comprising:

an elongate track channel having an underside and an upper panel that includes opposite underside panels disposed in a spaced parallel position on the underside of said track channel and opposite side base panels disposed perpendicularly to said respective underside panels and defining a slideway therebetween;

means for securing the electrical wire bundle with lamp sockets to extend along said track channel upper panel; and means for releasibly securing said track channel carrying the electrical wire bundle with lamp sockets in a selected position on said building structure.

2. Mounting apparatus as set forth in claim 1 wherein said means for securing comprises:

a plurality of resilient clips each having a central portion and a tooth flange disposed at generally right angles to the central portion at each end, said tooth flanges serving to grip around said track channel upper panel.

3. Mounting apparatus as set forth in claim 2 wherein each of said resilient clips further comprises:

a central portion that includes a middle raised band for positive gripping of the wire bundle.

4. Mounting apparatus as set forth in claim 1 wherein said elongate track channel further includes:

a central groove formed on said upper panel for receiving said electrical wire bundle.

5. Mounting apparatus as set forth in claim 4 wherein said means for securing comprises:

clamp means having resilient, opposite flanges for gripping a socket and bulb, said clamp means having opposite side tangs for gripping each edge of said upper panel.

6. Mounting apparatus as set forth in claim 1 wherein said means for releasibly securing comprises:

an elongate slide channel having opposite side guides for captively receiving opposite outside edges of said base panels.

7. Mounting apparatus as set forth in claim 1 wherein said means for releasibly securing comprises:

an elongate slide guide having opposite side guide channels opening outward on each side of said slide guide for captively receiving opposite inside edges of said base panels.

8. Mounting apparatus as set forth in claim 7 wherein:

a plurality of elongate track channels supporting an electrical wire bundle with lamp sockets are slidably received within a plurality of elongate slide guides secured to said building structure.

9. Mounting apparatus as set forth in claim 1 which further includes:

plural elongate tabs for firm seating at spaced intervals between roof and shingles to expose plural tab ends having a securing button thereon, which tab end securing buttons are firmly received in said track channel slideways.

10. Mounting apparatus as set forth in claim 9 wherein:

said plural tab ends are bent at ninety degrees so that said track channels are disposed in a generally vertical attitude.

11. Mounting apparatus as set forth in claim 1 wherein said means for releasibly securing comprises:

a plurality of unitarily formed panels each having one end formed to provide a button to be received in said base panel slideway of respective track channels, with the other end formed into a hook formation for captive positioning over a roof gutter edge.

12. Mounting apparatus as set forth in claim 1 which further includes:

a wireform stake formed of metal rod as a first leg bent 180° at the center to form a second leg the length of upper panel width and bent at 90° to form a third leg and bent 90° to form a fourth leg extending parallel to said first leg and spaced therefrom by the width of said upper panel.

13. Mounting apparatus as set forth in claim 1 which further includes:

at least one selected ornamental shape formed of light transmissive plastic and extending a lower generally cylindrical portion having a bottom rim with opposed cut-out portions shaped for snap-fit onto said track channel upper panel to envelop at least one lamp socket.

* * * * *

UNITED STATES PATENT AND TRADEMARK OFFICE

CERTIFICATE OF CORRECTION

PATENT NO. : 5,707,136

DATED : January 13, 1998

INVENTOR(S) : Thomas L. Byers

It is certified that error appears in the above-identified patent and that said Letters Patent is hereby corrected as shown below:

On the title page, item [56], insert the following information:

| | | | | |
|---|---|---|---|---|
| 5,110,078 | 05-05-92 | Gary | 248 | 206.2 |
| 5,297,013 | 03-22-94 | Hall et | 362 | 363 |
| 5,238,425 | 8/1993 | Kliewer | 362 | 249 |
| 5,513,081 | 4/1996 | Byers | 362 | 249 |
| 5,526,246 | 6/1996 | Liou | 362 | 249 |
| 5,442,531 | 8/1995 | Lee | 362 | 249 |

Signed and Sealed this

Seventeenth Day of March, 1998

*Attest:*

*Attesting Officer*

BRUCE LEHMAN

*Commissioner of Patents and Trademarks*